US008858202B2

(12) United States Patent
Al-Hawaj

(10) Patent No.: US 8,858,202 B2
(45) Date of Patent: Oct. 14, 2014

(54) ROTARY DIAPHRAGM PUMP

(75) Inventor: Osama M. Al-Hawaj, Mubark Al-Kabeer (KW)

(73) Assignee: Kuwait University, Safat (KW)

( * ) Notice: Subject to any disclaimer, the term of this patent is extended or adjusted under 35 U.S.C. 154(b) by 191 days.

(21) Appl. No.: 13/570,035

(22) Filed: Aug. 8, 2012

(65) Prior Publication Data

US 2014/0044579 A1 Feb. 13, 2014

(51) Int. Cl.

| | |
|---|---|
| ***F01C 5/00*** | (2006.01) |
| ***F03C 2/00*** | (2006.01) |
| ***F03C 4/00*** | (2006.01) |
| ***F04C 2/00*** | (2006.01) |

(52) U.S. Cl.
USPC ..... 418/45; 418/5; 418/15; 418/150; 418/152; 417/412; 417/477.7

(58) Field of Classification Search
USPC ..... 418/5, 7, 15, 45, 150, 152–153, 270; 417/412, 477.7, 474–477, 477.1
See application file for complete search history.

(56) References Cited

U.S. PATENT DOCUMENTS

| | | | | |
|---|---|---|---|---|
| 2,811,925 A | | 11/1957 | Crookston | |
| 2,885,966 A | * | 5/1959 | Ford | 417/477.7 |
| 3,137,242 A | * | 6/1964 | Hahn | 417/477.7 |
| 3,148,624 A | | 9/1964 | Baldwin | |
| 3,216,362 A | * | 11/1965 | Hewko | 418/45 |
| 3,507,585 A | * | 4/1970 | Mercer | 418/45 |
| 3,677,668 A | * | 7/1972 | Rosenberg | 418/45 |
| 5,707,217 A | | 1/1998 | Loeffler | |

FOREIGN PATENT DOCUMENTS

| | | | | |
|---|---|---|---|---|
| JP | 59074387 A | * | 4/1984 | 417/477.7 |

* cited by examiner

*Primary Examiner* — Theresa Trieu
(74) *Attorney, Agent, or Firm* — Richard C. Litman

(57) ABSTRACT

The rotary diaphragm pump has a flexible, resilient diaphragm band surrounding an elliptical frame within a case having four chambers surrounding an elliptical core. An articulating mechanism has a plurality of wheels traveling along the elliptical edges of the frame. The mechanism extends and retracts as the wheels move from maximum extension along the major axis of their elliptical tracks to minimum extension at the minor axis of their tracks. This mechanism drives a pair of actuator rollers along the inner surface of the diaphragm, periodically forcing the diaphragm into the surrounding chambers to produce the pumping action. Each chamber has an inlet port and an outlet port. The various ports may be interconnected to provide one or more multi-stage pumps in combination with one or more single-stage pumps, as desired. Two or more pumps may be joined in tandem to provide greater capacity from a single drive shaft.

17 Claims, 17 Drawing Sheets

ROTARY DIAPHRAGM PUMP

BACKGROUND OF THE INVENTION

1. Field of the Invention

The present invention relates generally to fluid transfer devices, and particularly to a rotary diaphragm pump having an elliptical band diaphragm driven by an articulating roller assembly.

2. Description of the Related Art

Fluid transfer devices, e.g., pumps, often use the principle of a distensible elastomeric diaphragm as the primary component therein. Various mechanisms are used to move the diaphragm and thereby change the volume of one or more chambers within the pump in order to move a fluid (air or liquid) through the pump. The diaphragm in such a pump generally has a flat, planar configuration when it is not distended by the drive mechanism. The diaphragm in such a pump configuration is secured about its periphery, and the drive mechanism generally is secured to the central area of the diaphragm. The stress imposed upon the diaphragm by being mechanically attached to other structure both about its periphery and its central area results in relatively large stress upon the diaphragm and correspondingly shortened life. Various hydraulically actuated diaphragm pumps have been developed in an effort to reduce the stress on the diaphragm, but such hydraulically actuated pumps generally suffer from reduced mechanical efficiency in comparison to mechanically actuated planar diaphragm pumps.

Another disadvantage of such conventional diaphragm pumps is that a single diaphragm generally corresponds to a single pump chamber. The efficiency and smoothness of operation of the pump is thus relatively limited in a manner somewhat analogous to a single cylinder reciprocating pump or engine, so that it has only one power stroke or pulse per revolution. In many applications, relatively smooth output of the pump, i.e., avoiding significant variations in output pressure during each revolution of the pump drive, is a very desirable feature. Conventional mechanically driven planar diaphragm pumps are incapable of providing such smooth fluid delivery unless equipped with additional components to smooth the pulses delivered from the pump.

Thus, a rotary diaphragm pump solving the aforementioned problems is desired.

SUMMARY OF THE INVENTION

The rotary diaphragm pump has a flexible, resilient diaphragm in the form of a closed band having an elliptical form when installed over an elliptical frame. The diaphragm band and frame assembly are installed in a case having four chambers surrounding the elliptical diaphragm and frame. An articulating mechanism is disposed in the center of the case and diaphragm. The articulating mechanism has drive wheels rolling along one or both of the elliptical inner edges of the diaphragm frame. The articulation of the mechanism as the wheels move from their maximum extension along the major axis of their elliptical tracks to their minimum extension at the minor axis of their tracks causes a pair of mutually opposed diaphragm rollers to bear against the inner surface of the diaphragm and alter the volumes of the four surrounding chambers accordingly to produce a pumping action.

Each of the four chambers has an inlet port and an outlet port. The various ports may be interconnected in various manners to provide either four single-stage pumps; two two-stage pumps; two single-stage pumps and one two-stage pump; a single-stage pump and a three-stage pump; or one four-stage pump, as desired. Optionally, two or more cases may be joined in tandem to provide greater pumping capacity from a single driveshaft.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The rotary diaphragm pump has a case defining a plurality of chambers surrounding an elliptical core or cavity. A corresponding elliptical frame and diaphragm assembly is disposed within the case. The diaphragm is in the form of a closed band that forms an elliptical shape when stretched over its frame. A mechanism urges the band outward into the chambers to provide pumping action in each of the chambers. The resulting multiple strokes or pulses in each revolution of the mechanism provide a relatively smooth flow from the pump, while the elliptical band configuration of the diaphragm results in relatively low stresses on the diaphragm.

Figure 1:
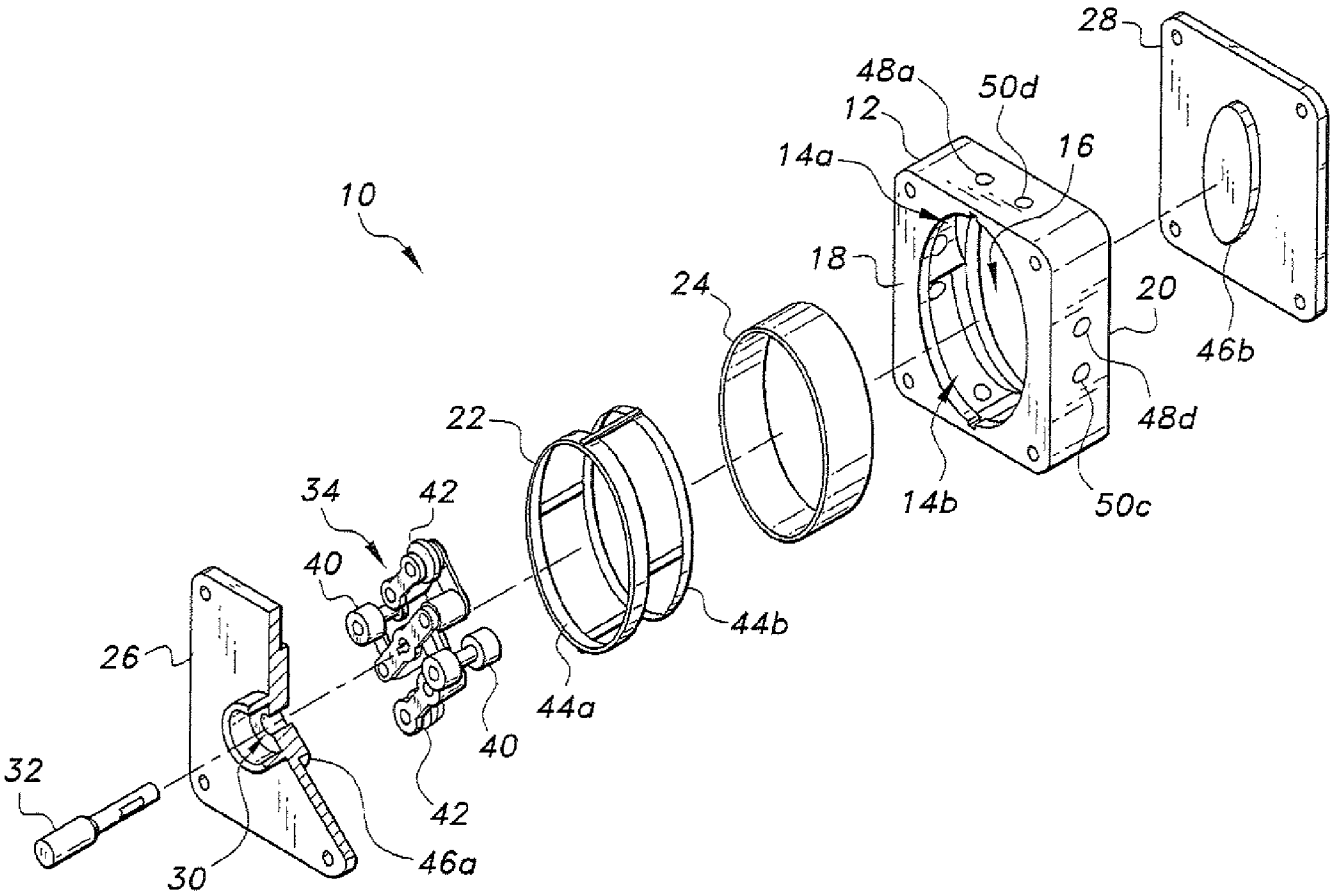
FIG. 1 is an exploded perspective view of a rotary diaphragm pump according to the present invention, one of the housing plates being broken away and partially in section to show details thereof.
Figure 2:
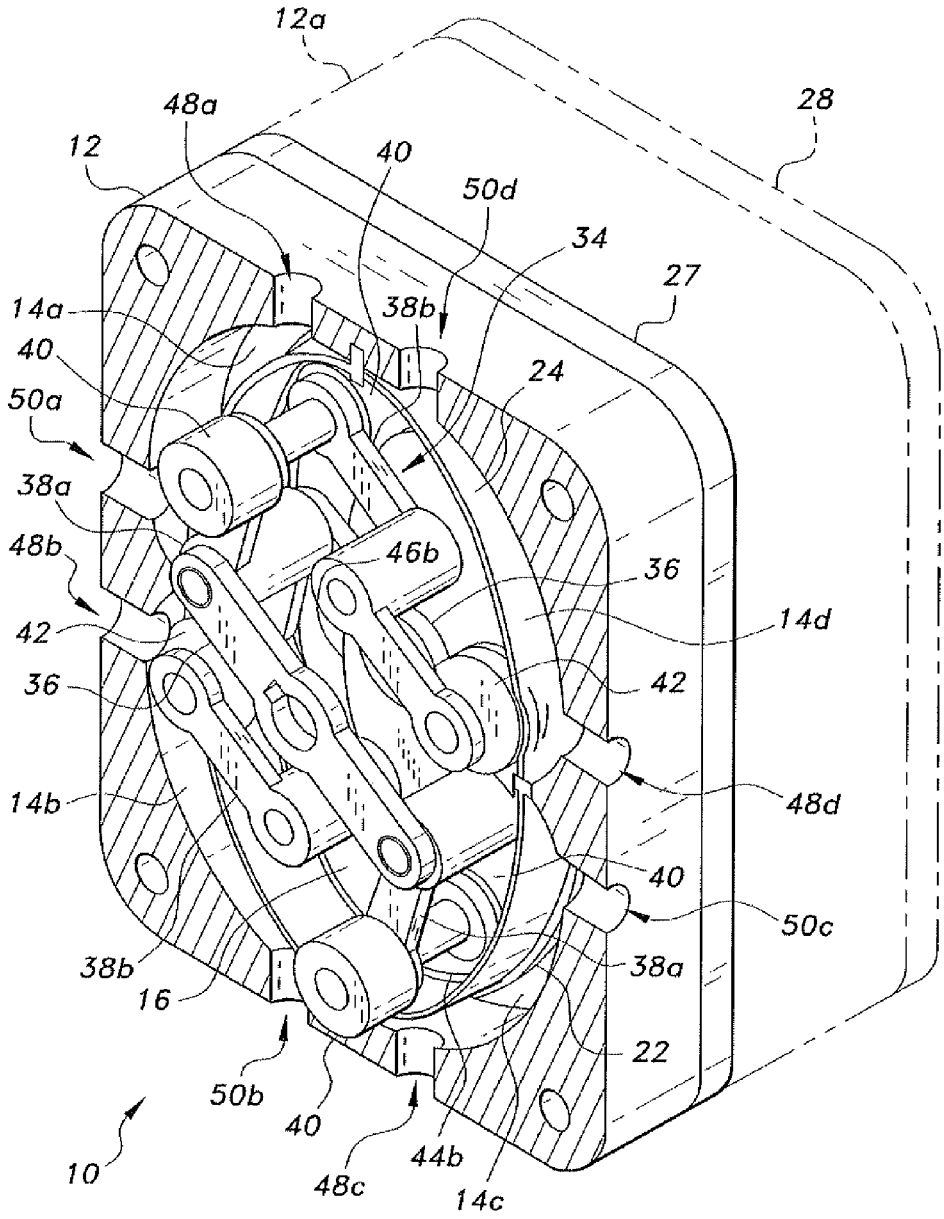
FIG. 2 is a perspective view in section of the rotary diaphragm pump of FIG. 1, shown assembled and illustrating its internal configuration.

FIGS. 1 and 2 of the drawings show a first embodiment of the rotary diaphragm pump 10, illustrating its basic components. The pump 10 has a case 12 having four chambers 14*a*, 14*b*, 14*c*, and 14*d* (defined counterclockwise from the upper left chamber 14*a*) surrounding an elliptical central cavity or core 16. The case 12 has mutually opposed first and second ends 18 and 20 having elliptical openings therethrough. An elliptical diaphragm frame 22 is installed in the elliptical cavity 16. The diaphragm frame 22 is formed by two elliptical hoops joined by spaced apart posts, leaving large gaps between the posts. A flexible, resilient, band-shaped diaphragm 24 is stretched over the exterior of the frame 22 prior to installation of the frame in the case 12. The frame 22 and the diaphragm 24 have substantially the same width as the axial thickness of the case 12. The diaphragm 24 separates the four chambers 14*a* through 14*d* from the elliptical cavity 16 in the center of the case 12. First and second end plates 26 and 28 attach to the respective ends 14 and 16 of the case 12. The first end plate 26 has a central passage or aperture 30 for the passage of a drive shaft 32 therethrough.

A diaphragm drive assembly or actuator assembly 34, comprising an articulating pantograph of generally rhomboid configuration, is also installed within the elliptical cavity 16 of the case 12. The diaphragm actuator 34 is shown in detail in FIGS. 2, 4A through 46, and 5A through 5E and FIGS. 6A-6D. The diaphragm actuator 34 is built upon a four-bar linkage assembly. Each of the four bars is a link 39 having the configuration shown in FIG. 6A. The link 39 has a cylindrical hub 39*c* having a first arm or leaf 39*a* extending radially outward from one end of the hub 39*c*, and a second arm of leaf 39*b* extending radially outward 180° opposite the first arm 39*a* from the opposite axial end of the hub 39*c*. The hub 39*c* has a bore extending through the hub 39*c* axially, and the end of each arm 39*a*, 39*b* has an aperture 39*e* defined therein.

Figure 6A:
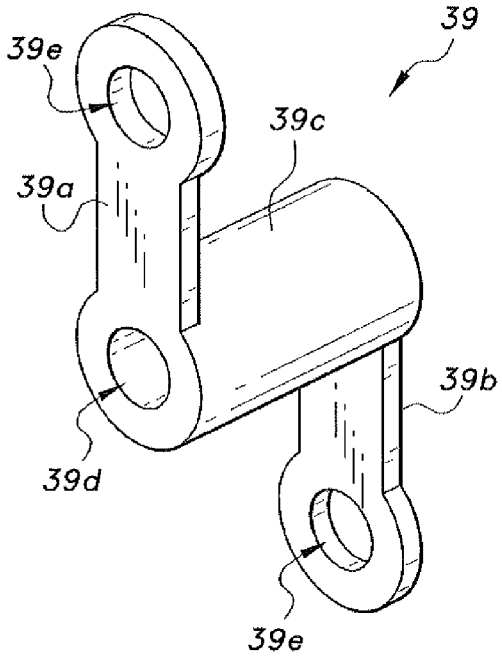
FIG. 6A is a perspective view of a first embodiment of a link bar used to form the articulating mechanism of a rotary diaphragm pump according to the present invention.
Figure 6B:
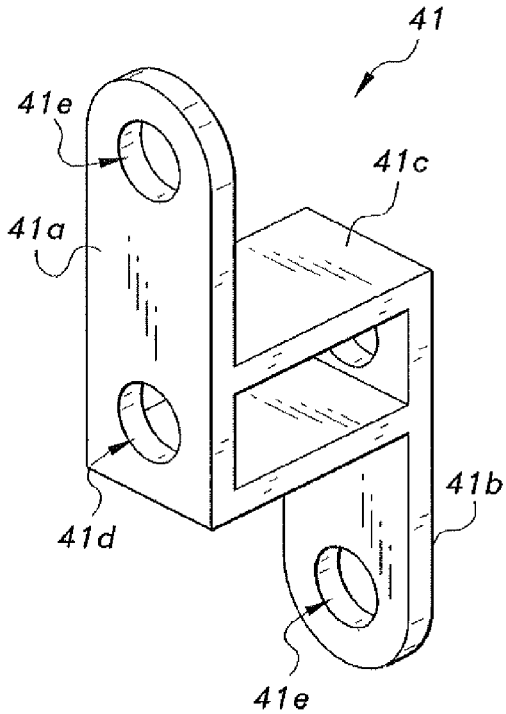
FIG. 6B is a perspective view of an alternative embodiment of a link bar used to form the articulating mechanism of a rotary diaphragm pump according to the present invention.
Figure 6C:
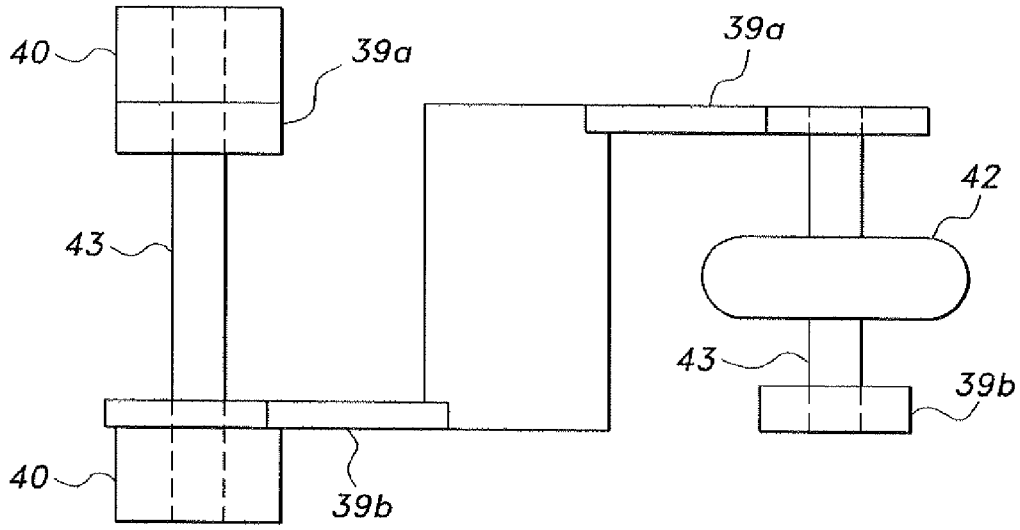
FIG. 6C is a side view of the articulating mechanism of a rotary diaphragm pump according to the present invention, background parts being omitted for clarity in the drawing.
Figure 6D:
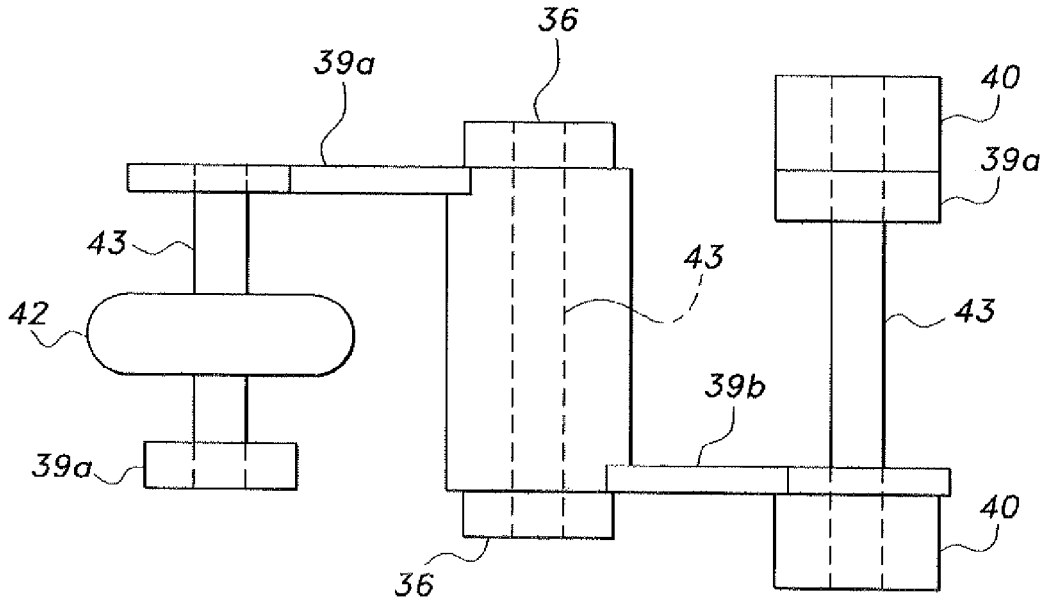
FIG. 6D is a side view of the articulating mechanism of a rotary diaphragm pump according to the present invention, shown from a direction rotated 90° from the orientation of FIG. 6C and with background parts being omitted for clarity in the drawing.

As shown in FIGS. 2, 6C and 6D, the links 39 are assembled in a four-bar loop with the end of the first arm 39*a* of one link aligned with the end of the second arm 39*b* at each of the four corners of the loop, the ends being joined by pivot pins 43. One pair of diagonally opposite corners of the four-bar linkage has a piston roller 42 rotatably mounted on the pivot pin between the ends of the link arms 39*a*, 39*b*. The other pair of diagonally opposite corners of the four-bar linkage has a pair of track wheels or cam rollers 40 rotatably mounted on the ends of the pivot pins 43, which extend outward from the ends of the link arms 39*a*, 39*b* (in some embodiments, the actuator has only a single track wheel 40 mounted on the pivot pins 43 and the diaphragm frame 22 has only a single track 44*a* or 44*b*). As shown in FIGS. 2 and 6D, a pair of parallel crank bars 36 extend between one pair of opposing hubs 39*c* on opposite sides of the four-bar linkage. The two crank bars are connected at their ends by pivot pins that extend through the hubs 39*c*. The center of the crank bars 36 defines a keyway. A keyed drive shaft 32 extends through the keyways in the crank bars 36.

An alternative embodiment of the links is shown in FIG. 6B. In this embodiment, the cylindrical hub 39*c* has been replaced by a rectangular box hub 41*c*. However, this link also has oppositely extending leafs or arms 41*a*, 41*b* that are offset from each other by the length of the hub 41*c*, a bore 41*d* extending axially through the hub 41*c*, and apertures 41*e* defined in the ends of the arms 41*a*, 41*b*, so that the link 41 functions in the same manner as the link 39.

The inner surfaces of the axially opposed ends of the diaphragm frame 22 serve as first and second elliptical tracks 44*a* and 44*b*. The guide wheels 40 roll along either or both of these two tracks 44*a*, 44*b* depending upon whether two guide wheels 40 are installed upon each pivot axle of the links 59, as noted further above. In addition, each of the end plates 26 and 28 includes an elliptical guide 46*a*, 46*b* protruding into the elliptical cavity. The guide wheels 40 are thus captured between their respective tracks 44*a* and/or 44*b* of the diaphragm frame 22 and the corresponding elliptical guides 46*a* and 46*b* of the first and second end plates 26 and 28. Accordingly, the guide wheels 40 articulate inward and outward according to their positions along the elliptical tracks 44*a*, 44*b* and guides 46*a*, 46*b*, retracting inward as they approach the minor axis of the ellipse and extending outward as they approach the major axis of the ellipse.

Figure 4A:
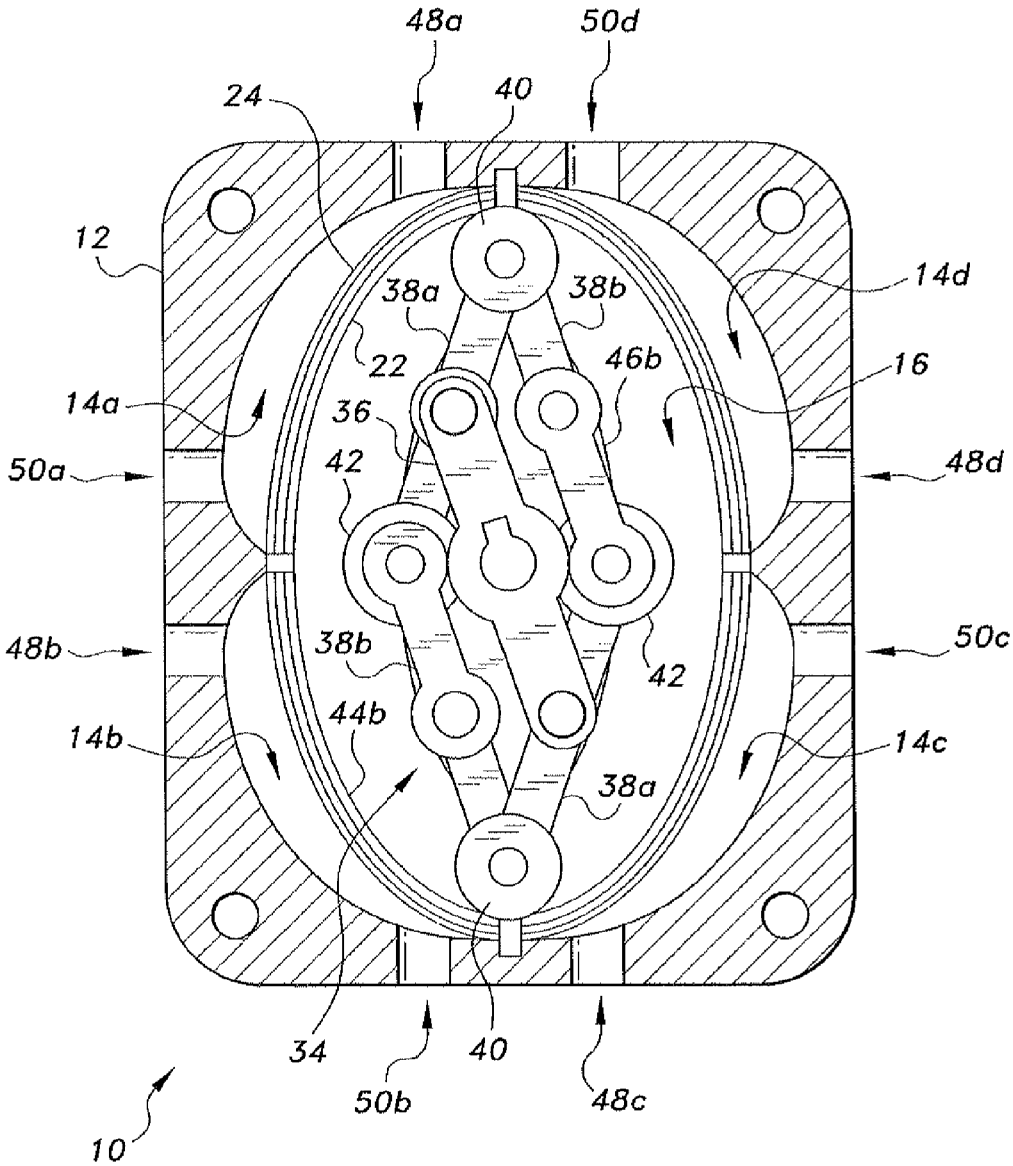
FIGS. 4A, 4B, 4C, 4D, 4E, 4F, and 4G are front views in section showing the sequential action of the pump mechanism of the rotary diaphragm pump of FIG. 1 within the case and the deflection of the diaphragm by the rollers of the mechanism to provide the pumping action.

The above-described operation of the rhomboid pantograph mechanism of the diaphragm actuator 34 results in the two piston rollers 42 moving in a direction directly opposite that of the wheels 40, i.e., the rollers 42 move outward as the wheels 40 move inward, with the rollers 42 moving inward as the wheels 40 move outward. FIGS. 4A through 4G illustrate the progressive articulation of the diaphragm actuator 34 as it rotates counterclockwise through 90° of rotation. In FIG. 4A, the two wheels 40 illustrated are essentially at their maximum extension along the major axis of the elliptical diaphragm frame 22 and the two piston rollers 42 are retracted along the minor axis of the diaphragm frame 22, i.e., at their closest approach to one another, providing maximum clearance between the two rollers 42 and the diaphragm 24.

Figure 4B:
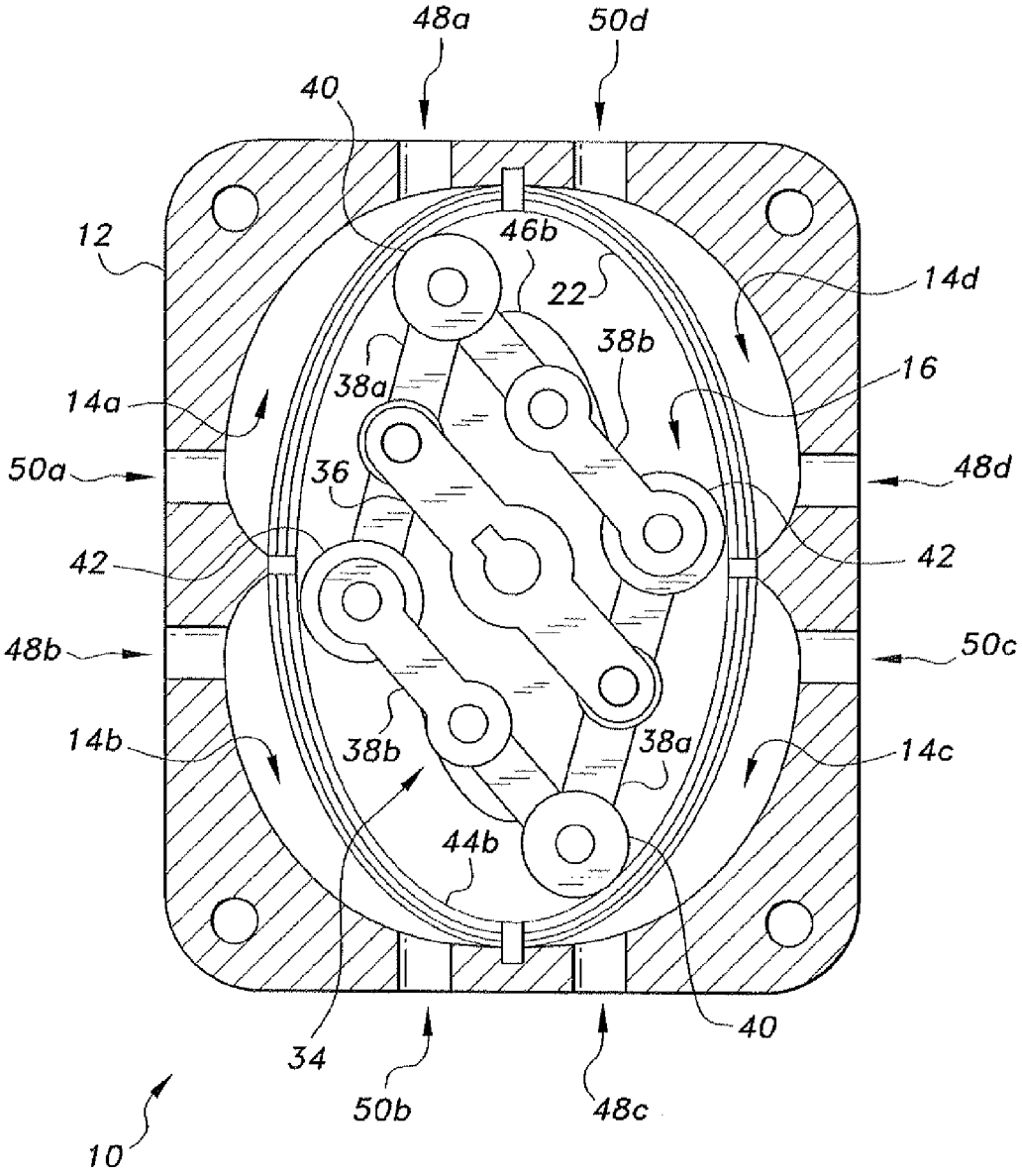

In FIG. 4B, the upper wheel 40 has rotated counterclockwise toward the first chamber 14*a*, and the corresponding opposite lower wheel 40 has rotated counterclockwise toward the third chamber 14*c*. The distance between the two wheels 40 must decrease, as the wheels are traveling from the longer major axis of the elliptical track 44*b* toward the shorter minor axis of the track. Accordingly, the linkage of the pantograph mechanism of the diaphragm actuator 34 causes the two piston rollers 42 to begin to move away from one another, so that the two rollers 42 just begin to contact the diaphragm 24 in FIG. 4B.

Figure 4C:
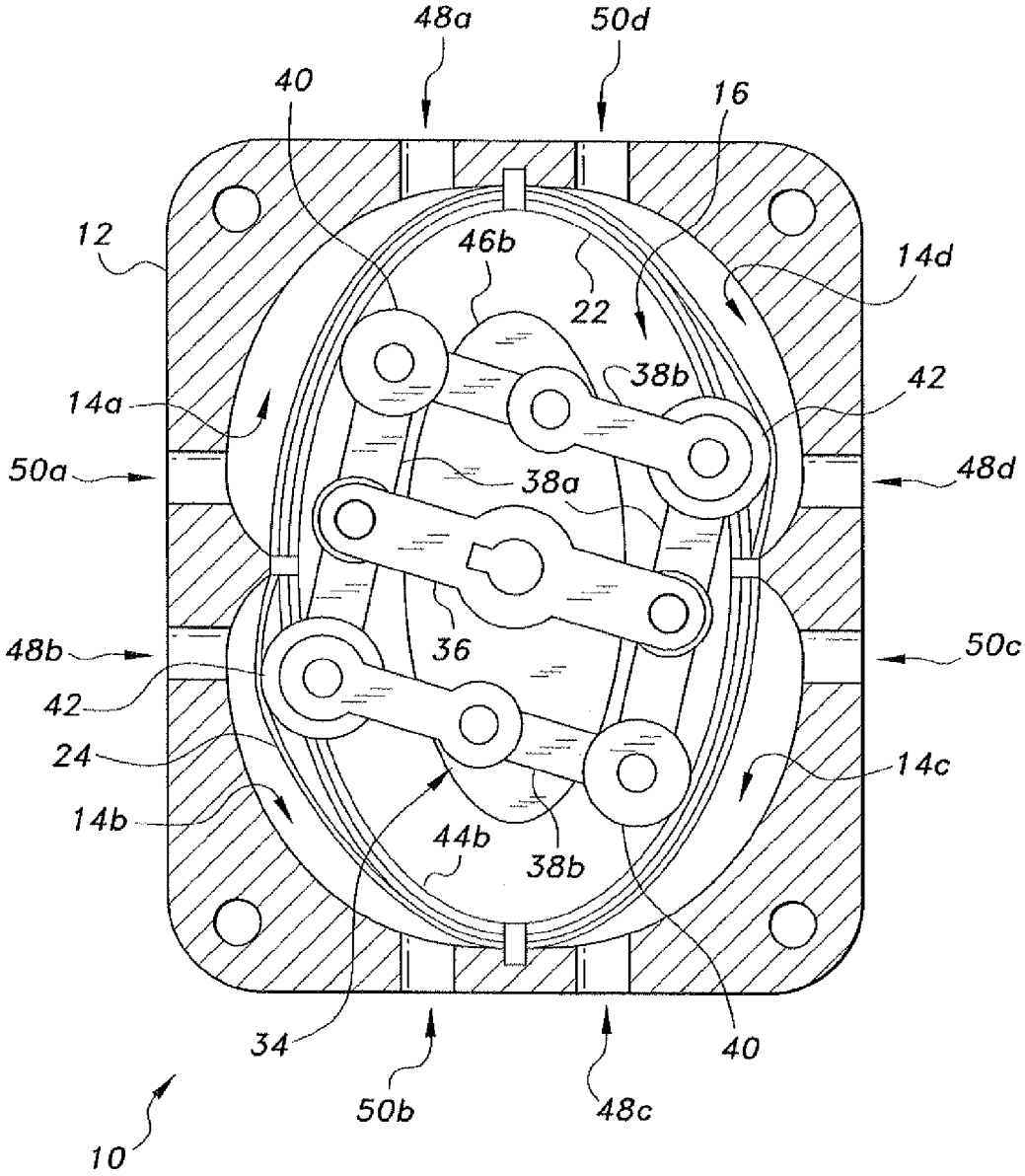

FIG. 4C illustrates the configuration and orientation of the diaphragm actuator 34 after about 30° of counterclockwise rotation. The two cam rollers or track wheels 40 are at their approximate medial positions relative to their maximum and minimum extension, so that the diaphragm actuator is very close to a square configuration. The two piston rollers 42 have correspondingly moved outward, where they are distending the diaphragm 24 into the two chambers 14*b* and 14*d* to reduce their volume. It will be seen that this results in any fluid within the chambers 14*b* and 14*d* being expelled from those chambers via their outlet ports (discussed further below).

Figure 4D:
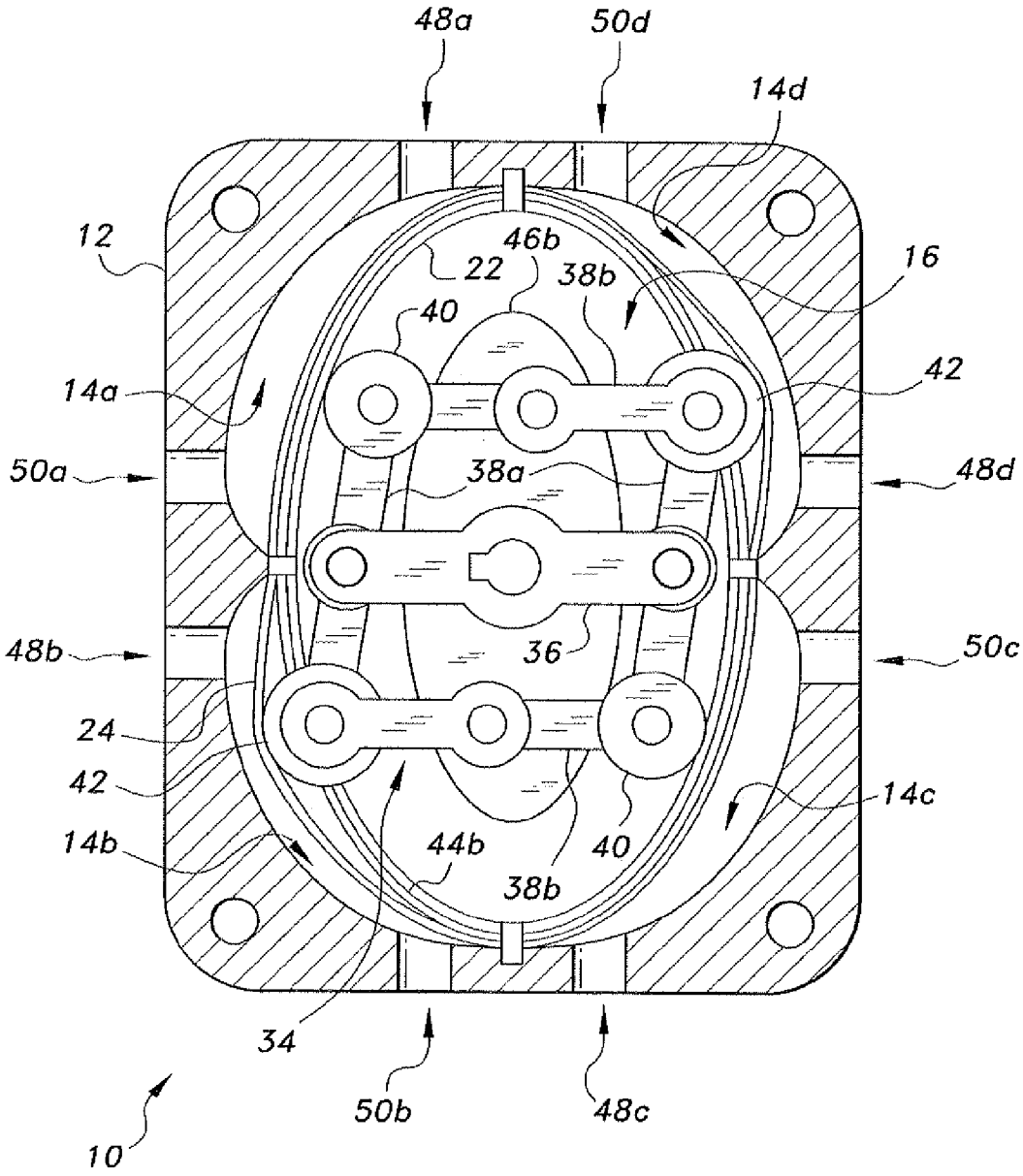

The two track wheels 40 are shown rotated about 45° degrees counterclockwise in FIG. 4D, so that the span between the wheels 40 decreases further as the wheels 40 approach the minor axis of the guide track 44*b* of the diaphragm frame 22. The two piston rollers 42 have correspondingly spread farther apart from one another, distending the diaphragm band 24 farther into the two chambers 14*b* and 14*d* to expel fluid from those two chambers.

Figure 4E:
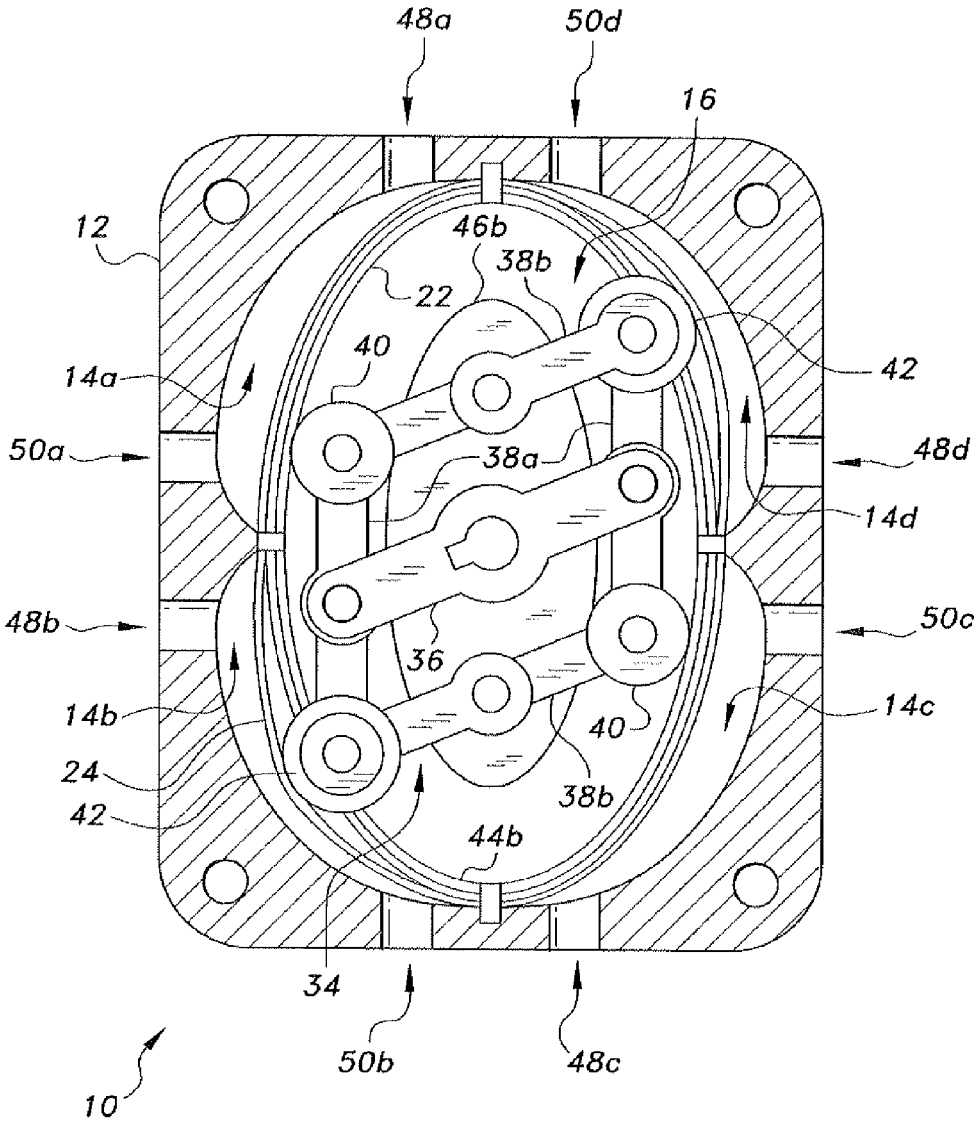

FIG. 4E shows the orientation and configuration of the articulating diaphragm actuator 34 as the track wheels 40 have rotated about 60° counterclockwise from the positions shown in FIG. 4A. The span between the two guide wheels 40 continues to decrease as they approach the minor axis of the elliptical diaphragm frame 22, and the two piston rollers 42 extend away from one another correspondingly to distend the diaphragm band 24 into the two chambers 14*b* and 14*d*.

Figure 4F:
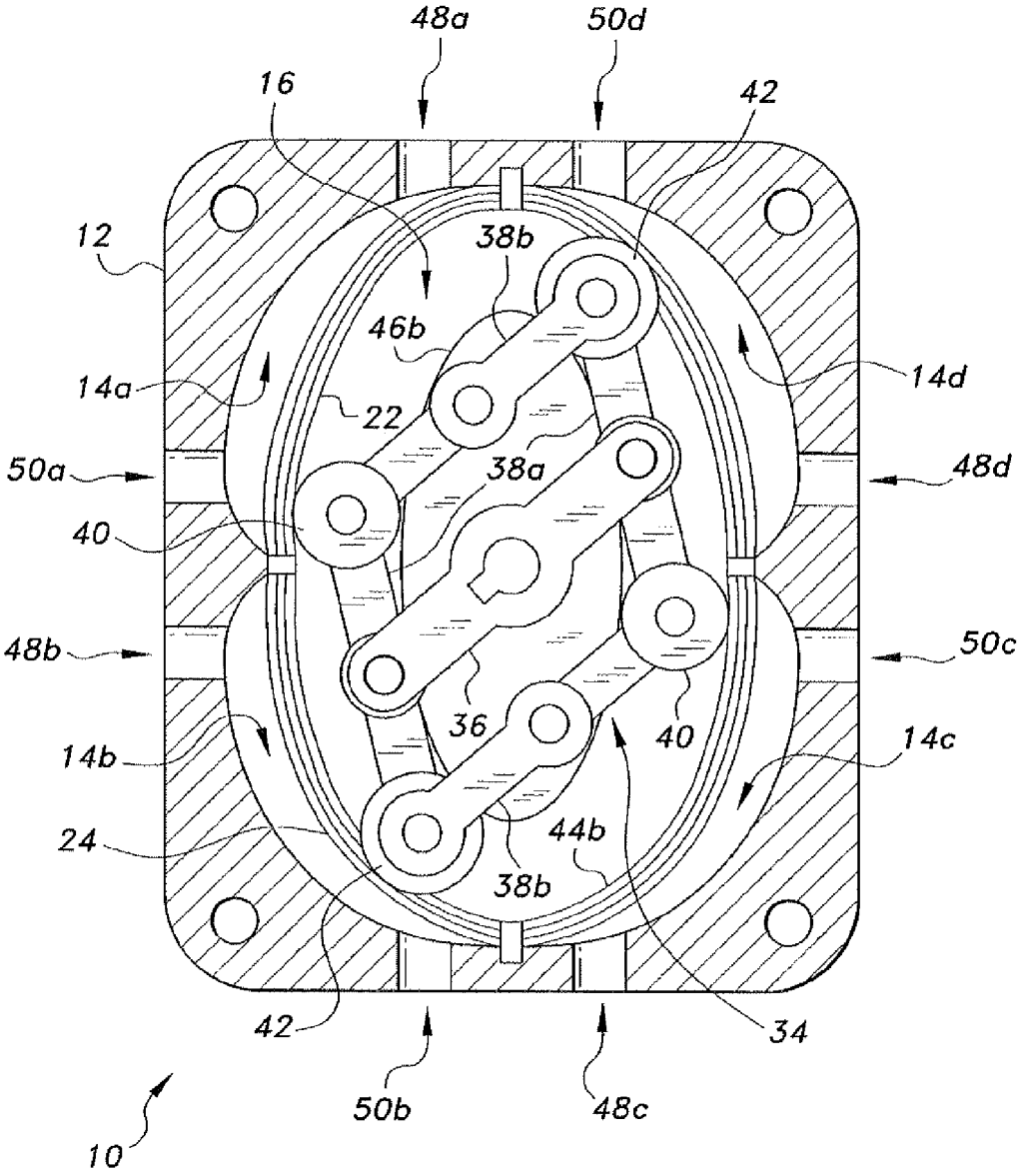

In FIG. 4F, the diaphragm actuator 34 has rotated about 75° degrees from its initial orientation, so that the track wheels 40 are nearly at their closest approach to one another due to the smaller span of the minor axis of the diaphragm frame 22 and its track 44*b*. The piston rollers 42 have correspondingly extended away from one another to nearly their maximum span. The two rollers 42 are accordingly approaching the major axis of the elliptical diaphragm frame 22. However, the span along the major axis of the diaphragm frame is slightly greater than the maximum span between the two diaphragm rollers 42. Thus, the two rollers 42 are distending the diaphragm 24 to a lesser degree than previously in the rotational cycle, even though the rollers 42 are still moving slightly farther away from one another at this position.

Figure 4G:
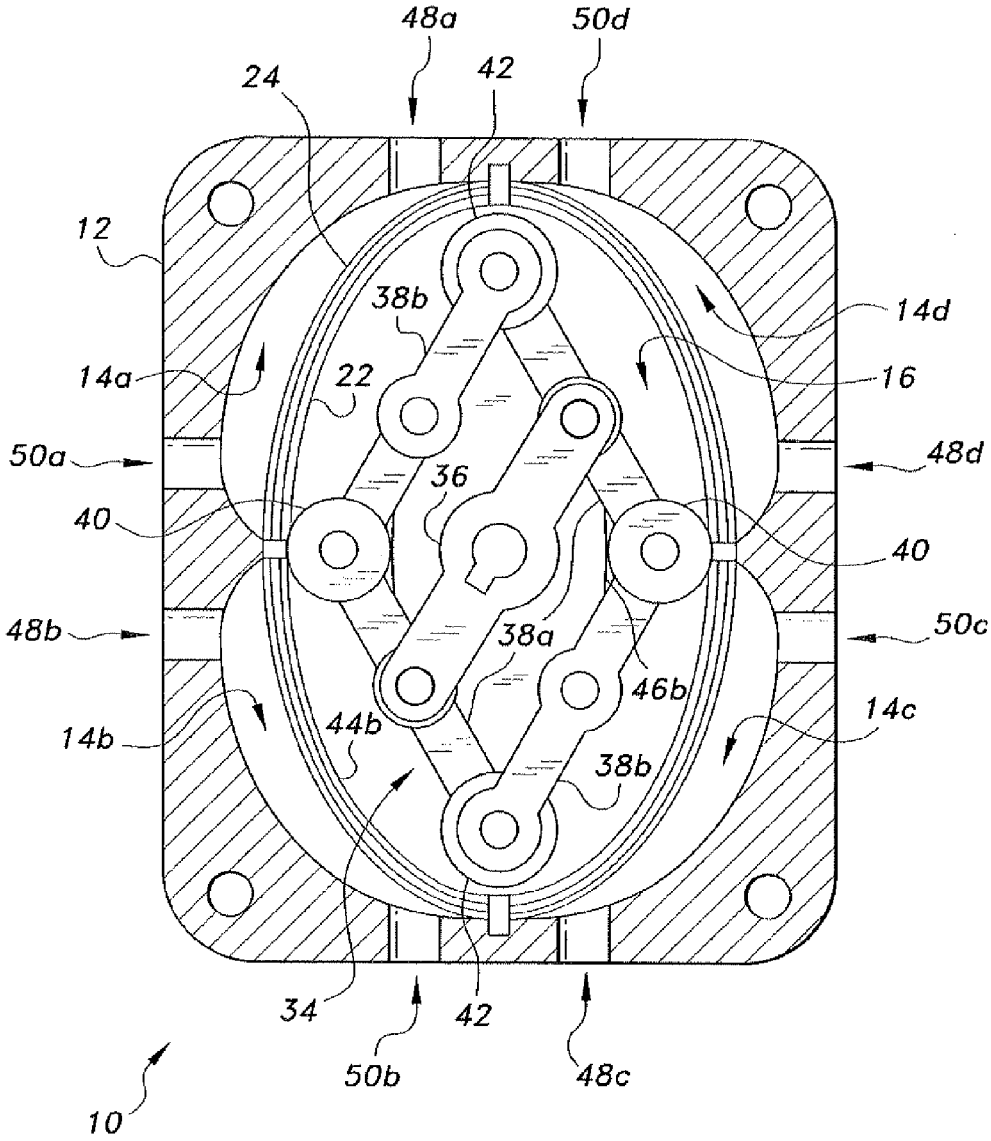

Finally, in FIG. 4G the track wheels 40 have rotated 90° from the starting position shown in FIG. 4A, i.e., they are oriented along the minor axis of the elliptical diaphragm frame 22 and are at their minimum span between one another. Accordingly, the two piston rollers 42 are at their maximum distance from one another, aligned along the major axis of the diaphragm frame 22. As noted above, the major axis of the diaphragm frame 22 is somewhat greater than the maximum span between the two piston rollers 42, thus allowing the rollers 22 to clear the interior ends of the case 12 as the diaphragm actuator 34 rotates within the case 12.

Further rotation of the diaphragm actuator through another 90° of rotation results in the two guide wheels 40 expanding away from one another as they travel toward the major axis of the diaphragm frame 22, so that the two piston rollers 42 correspondingly retract toward one another. However, it will be seen that the piston rollers 42 will extend beyond the elliptical shape of the diaphragm 24, just as they did through much of the first 90° of rotation of the diaphragm actuator 34. Thus, the rollers 42 will distend the portions of the diaphragm 24 across the first and third chambers 14*a* and 14*c* through the second quadrant of rotation, pumping fluid from those two chambers 14*a*, 14*c* while fluid is drawn into the other two chambers 14*b* and 14*d*. When the diaphragm actuator 34 has rotated through 180° of rotation, the cycle continues in the pattern shown in FIGS. 4A through 4G, but with the two track wheels 40 and the two piston rollers 42 reversed in their positions in the case 12. The pump operation continues as described. The rotary diaphragm pump 10 produces eight pump strokes per revolution of the diaphragm actuator 34 due to the four chambers 14*a* through 14*d* and the two piston rollers 42. While FIGS. 4A through 4G illustrate the operation of the rotary diaphragm pump 10 in counterclockwise rotation, it will be seen that the pump 10 is equally capable of rotating in the opposite clockwise direction with no structural changes. Such reversed rotation results in reversal of the direction of the flow of fluid moved through the pump 10.

Figure 3:
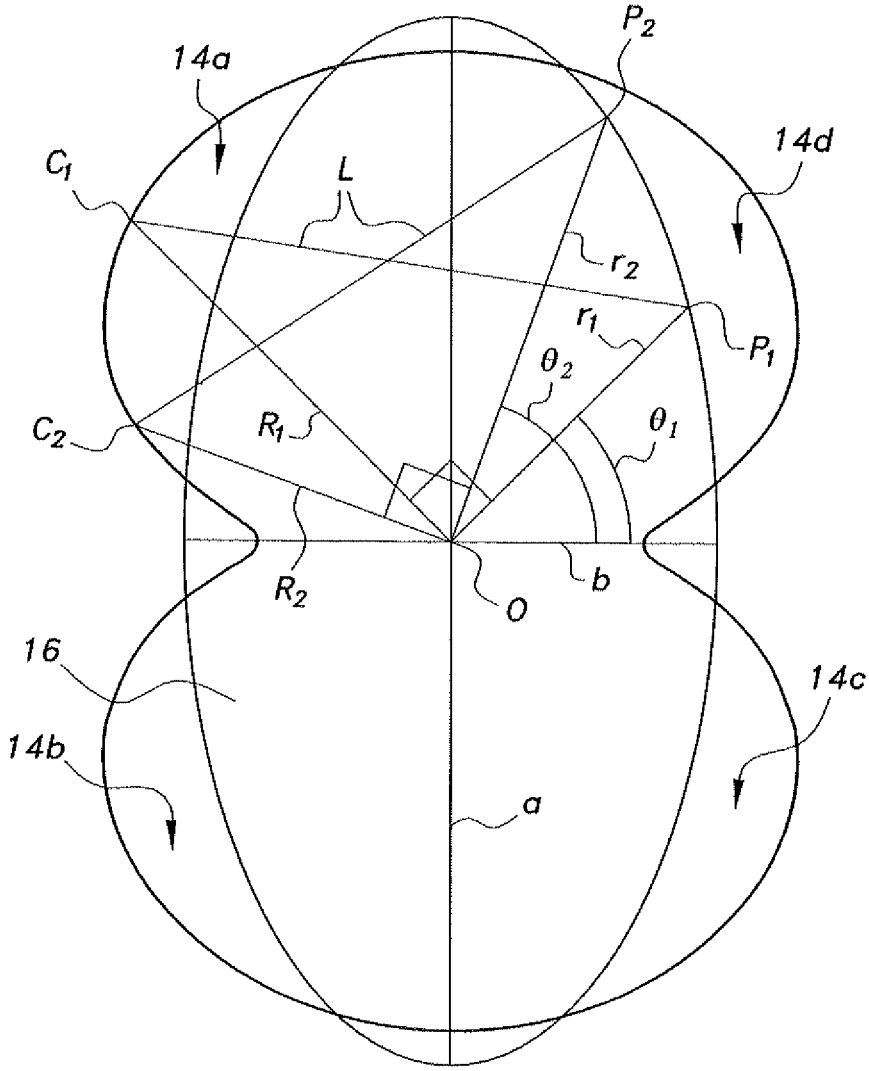
FIG. 3 is a schematic geometric diagram of the outline of the internal volume of the case of the rotary diaphragm pump of FIG. 1, showing the elliptical path of the cam and followers superimposed thereon.

FIG. 3 is a schematic geometric diagram showing the shapes of the chambers 14*a* through 14*d* superimposed over the elliptical outline of the central cavity 16 of the device. The curve generating the outline of the chambers 14*a*-14*d* is developed by constructing a right triangle having its right angle at the center or origin O of the elliptical cavity 16, having a first leg defined as the distance between the origin O and a point along the periphery of the elliptical cavity and a second leg defined as the distance between the origin O and a point along the periphery of the chambers 14*a* through 14*d*. The hypotenuse of the triangle is a constant length. Only the length of the other two legs varies according to the locations of their end points along the respective peripheries of the elliptical cavity 16 and the chambers 14*a* through 14*d*. The triangle is then rotated about the origin O so that the distal end of the second leg generates a continuous series of points defining the chambers 14*a* through 14*d*. The result is a shape somewhat resembling the Arabic numeral 8.

It will be seen that the curve of the outline of the chambers 14*a*-14*d* will vary according to the eccentricity e of the elliptical cavity 16, which is defined according to the equation $e=\sqrt{1-(b/a)^2}$, where b is the minor axis of the ellipse and a is the major axis of the ellipse. Thus, the width of the narrowed central span of the chambers 14*a*-14*d* will decrease as the eccentricity e of the ellipse increases, i.e., the minor axis b of the ellipse becomes a smaller fraction of the major axis a. It will be seen that the width of the narrowed central span of the four chambers 14*a* through 14*d* will approach zero as the eccentricity e of the ellipse approaches infinity. The opposite extreme is found when the ellipse has an eccentricity e of zero, i.e., it is a circle. In this case all three of the legs of the triangle will remain of constant length as the triangle is rotated about the origin, i.e., the result will be another circle.

In the example of FIG. 3, a first leg $r_1$ of the first triangle extends from the origin O at an angle $\theta_1$ from the minor axis b of the ellipse to a point $P_1$ on the periphery of the ellipse 16. A first leg $r_2$ of the second triangle extends from the origin O at an angle $\theta_2$ from the minor axis a. The lengths of the legs $r_1$ and $r_2$ vary according to the angles $\theta_1$ and $\theta_2$ from the minor axis a due to the elliptical shape to which they extend. The opposite legs $R_1$ and $R_2$ extending from the origin O to points $C_1$ and $C_2$ on the periphery of the chambers 14*a* through 14*d* will also vary in length. However, the lengths L of the hypotenuses of both of these triangles are equal to one another, i.e., the length L is fixed. Thus, as the triangles are defined by their right angles between their two legs $r_1$, $R_1$ and $r_2$, $R_2$ and the lengths L of their hypotenuses are equal to one another, the points $C_1$ and $C_2$ will be defined accordingly. The locations of the points $C_1$, $C_2$, etc. are determined according to the equation $R=\sqrt{L^2-r^2}$ where R is the radial distance from the center of the elliptical cavity to the periphery of the chambers, L is the fixed length hypotenuse of a right triangle having its right angle at the center of the elliptical cavity, and r is the length of the leg of the right triangle extending from the center of the elliptical cavity to a point along the periphery of the elliptical cavity. It will be seen that the procedure described herein for generating these two points $C_1$ and $C_2$ may be expanded to generate a large number of such points, thereby defining the periphery of the four chambers 14*a* through 14*d*. Allowance is made for the radii of the track wheels 40 and the piston rollers 42 of the diaphragm actuator 34 to arrive at the final shape.

The rotary diaphragm pump lends itself to several output configurations, depending upon the interconnections (or lack thereof) between the various inlet and outlet ports of the device. The case 12 includes four inlet ports 48*a* through 48*d*, respectively, for the four chambers 14*a* through 14*d*, and four outlet ports 50*a* through 50*d* for the chambers 14*a* through 14*d*. These various inlet and outlet ports may be connected with one another using interconnecting passages and corresponding one-way check valves to provide a number of different pump configurations, as shown in FIGS. 5A through 5E.

Figure 5A:
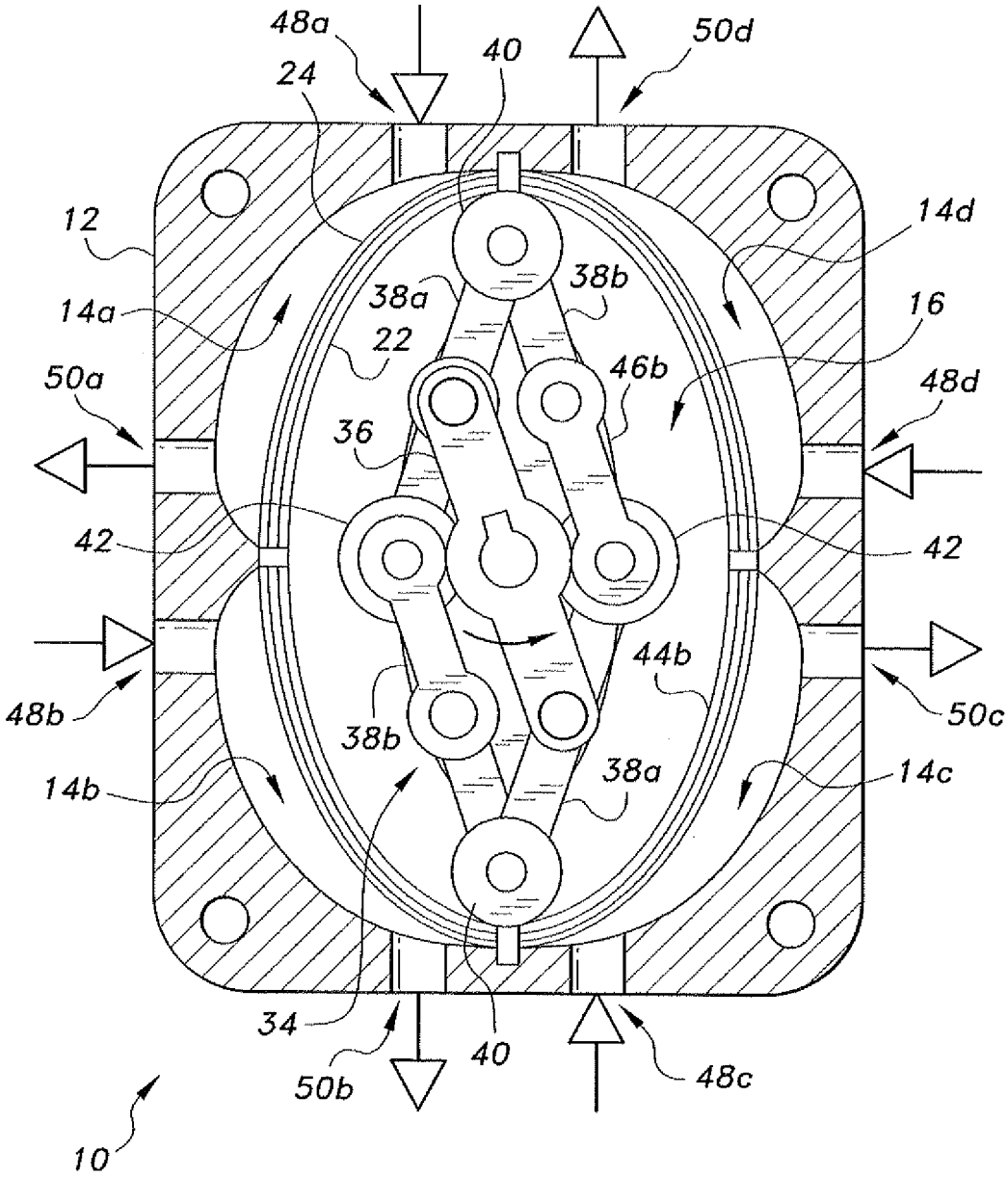
FIGS. 5A, 5B, 5C, 5D and 5E are front views in section illustrating different combinations of inlet and outlet paths made possible by the rotary diaphragm pump of FIG. 1.

The basic configuration illustrated in FIG. 5A does not include any passages interconnecting any of the various chambers of the pump. In this configuration each of the chambers 14*a* through 14*d* comprises a single isolated pump, so that the rotary diaphragm pump 10 of FIG. 5A provides four single stage pumps. Each of the chambers and pumps may be connected to different inlets and outlets from one another and may operate independently (except for the common drive for the articulating diaphragm actuator 34) to transfer different fluids to and from different sources.

Figure 5B:
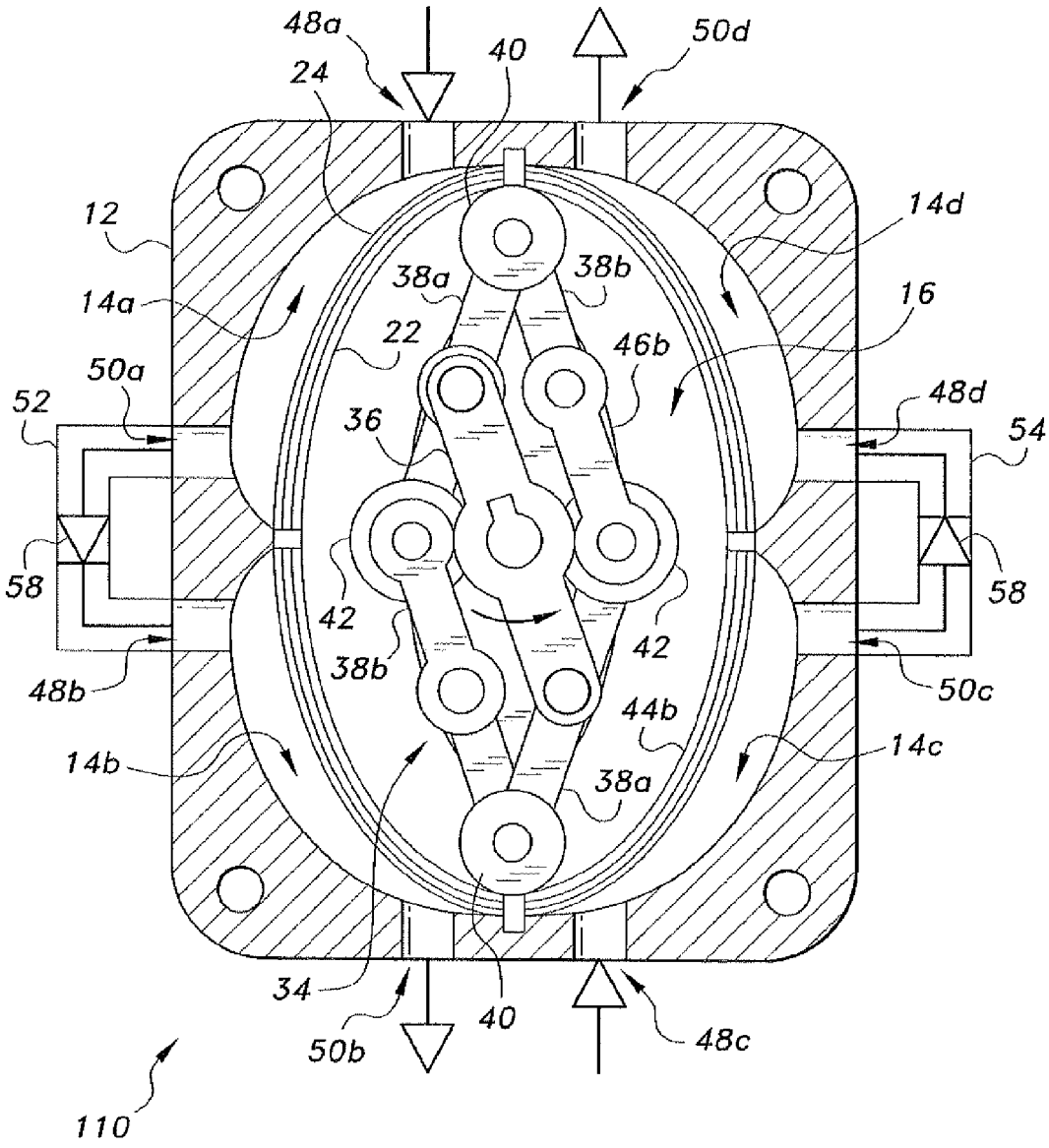

The rotary diaphragm pump 110 of FIG. 5B is identical to the pump 10 of FIGS. 1, 2, and 4A through 4G, with the exception of its external interconnecting passages. The pump 110 includes a first interconnecting passage 52 extending between the outlet port 50*a* of the first chamber 14*a* and the inlet port 48*b* of the second chamber 14*b*, and an opposite second interconnecting passage 54 extending between the outlet port 50*c* of the third chamber 14*c* and the inlet port 48*d* of the fourth chamber 14*d*. The interconnection of the first and second chambers 14*a* and 14*b* results in a two-stage pump.

Fluid enters the first chamber 14*a* through the first inlet port 48*a* and is pumped from the first chamber 14*a* into the second chamber 14*b*, and thence pumped from the second chamber 14*b*, where the fluid exits from the second chamber outlet port 50*b*. Similarly, the third chamber 14*c* pumps fluid into the fourth chamber 14*d* from the third inlet port 48*c* by means of the second interconnecting passage 54. The third and fourth chambers 14*c* and 14*d* comprise a second two-stage pump with fluid exiting from the fourth outlet port 50*d*. Each of the interconnecting passages 52 and 54 includes a one-way check valve 58 therein to prevent return of fluid from the secondary chamber back to the primary chamber. It will be seen that the direction of operation of the pump 110 (and other pumps incorporating various interconnecting passages) may be reversed easily by reversing the orientation of the check valve(s) 58 and reversing the direction of rotation of the drive mechanism.

Figure 5C:
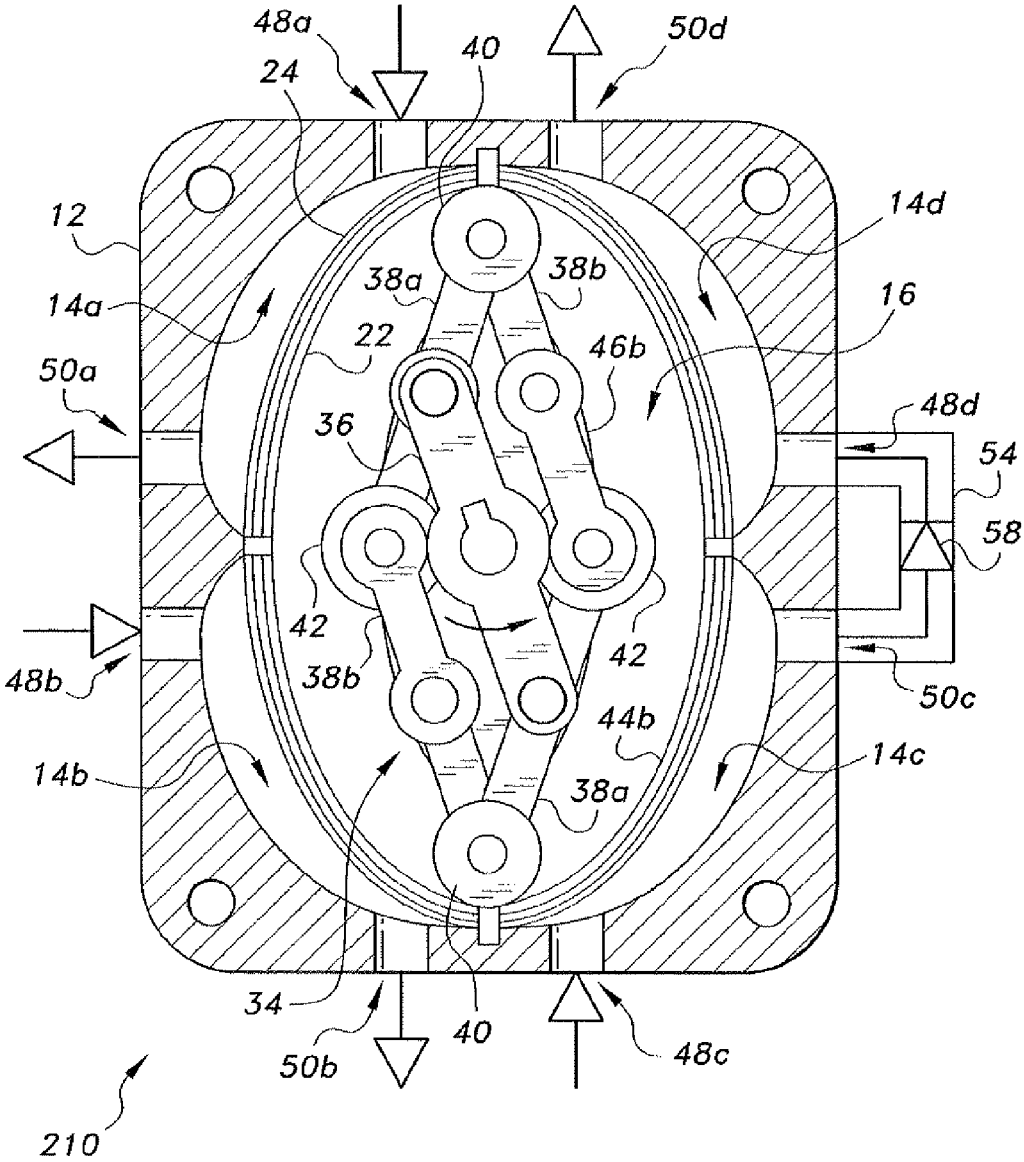

The rotary diaphragm pump 210 of FIG. 5C is also configured similar to the pumps 10 of FIGS. 1, 2, and 4A through 4G, as well as being similar to the pump 110 of FIG. 5A. The exception is the single interconnecting passage 54 between the third and fourth chambers 14*c* and 14*d* in the pump configuration 210 of FIG. 5C. The pump 210 of FIG. 5C includes two single-stage pumps and a two-stage pump. The first single-stage pump comprises the first chamber 14*a*, which draws fluid in through its inlet port 48*a* and expels that fluid from its outlet port 50*a*. The second single-stage pump is independent of the first single-stage pump (except for their common drive), and draws fluid in through its inlet port 48*b* and expels the fluid from its outlet port 50*b*. The two-stage pump comprises the third and fourth chambers 14*c* and 14*d*. Fluid is drawn in through the inlet port 48*c* of the third chamber 14*c*, passes through the interconnecting passage 54 between the outlet port 50*c* of the third chamber 14*c* and the inlet port 48*d* of the fourth chamber 14*d*, and is then expelled from the outlet port 50*d* of the fourth chamber 14*d*.

Figure 5D:
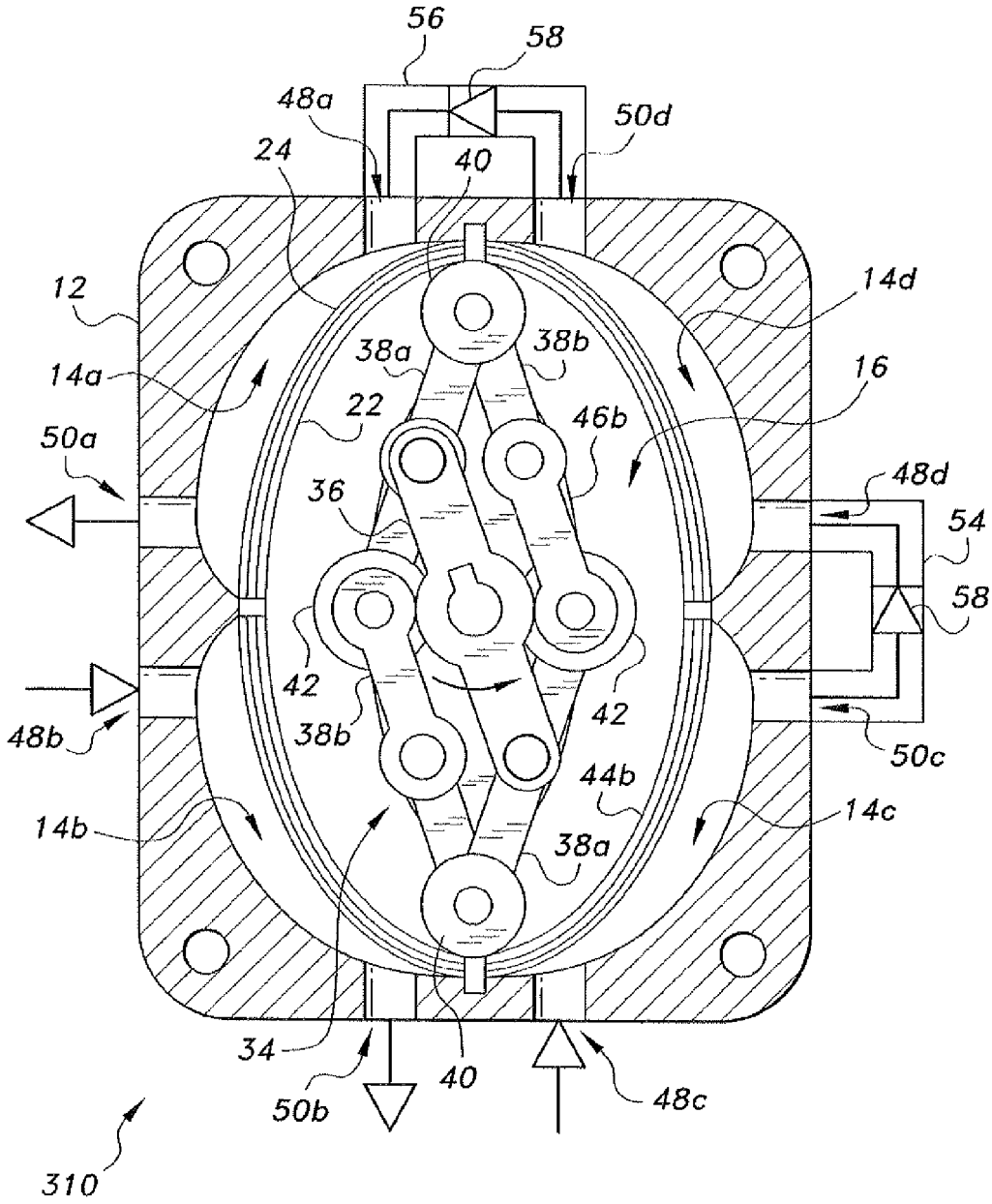

The rotary diaphragm pump 310 of FIG. 5D is also configured similar to the pumps 10 of FIGS. 1, 2, and 4A through 4G, the pump 110 of FIG. 5A, and the pump 210 of FIG. 5B. However, the pump 310 of FIG. 5D includes only one single-stage pump and a three-stage pump. The single-stage pump comprises the second chamber 14*b*, which draws fluid in through its inlet port 48*b* and expels that fluid from its outlet port 50*b*. The three-stage pump comprises the third, fourth, and first chambers 14*c* and 14*d*, in which fluid is drawn in through the inlet port 48*c* of the third chamber 14*c*, passes through the interconnecting passage 54 between the outlet port 50*c* of the third chamber 14*c* and the inlet port 48*d* of the fourth chamber 14*d*, continues through the third interconnecting passage 56 from the outlet port 50*d* of the fourth chamber 14*d* to the inlet port 48*a* of the first chamber 14*a*, and is then expelled from the outlet port 50*a* of the first chamber 14*a*.

Figure 5E:
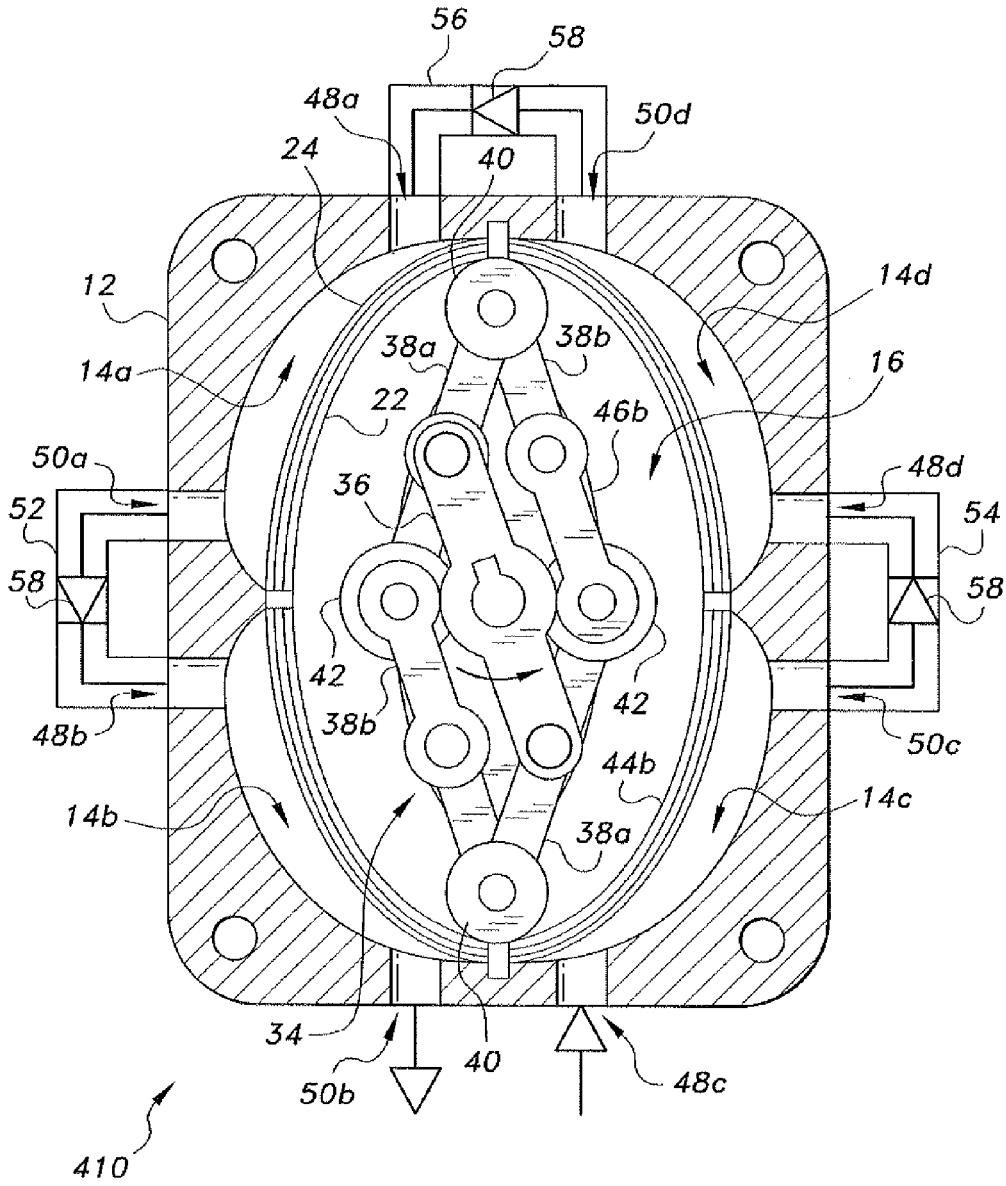

The rotary diaphragm pump 410 of FIG. 5E is also configured similar to the other pumps discussed further above. However, the pump 410 of FIG. 5E comprises only one four-stage pump. The four-stage pump 410 draws fluid in through the inlet port 48*c* of the third chamber 14*c*, passes the fluid through the interconnecting passage 54 between the outlet port 50*c* of the third chamber 14*c* and the inlet port 48*d* of the fourth chamber 14*d*, the fluid continuing through the third interconnecting passage 56 from the outlet port 50*d* of the fourth chamber 14*d* to the inlet port 48*a* of the first chamber 14*a*, whereupon the first chamber 14*a* pumps the fluid from its outlet port 50*a* through the interconnecting passage 52 to the inlet port 48*b* of the second chamber 14*b*, the fluid being expelled from the outlet port 50*b* of the second chamber 14*b*. This configuration has the potential to increase the pressure of the delivered fluid at the outlet port 50*b* to a significantly higher level than that provided by a lesser number of pump stages.

It will be seen that the arrangements of the various interconnecting passages 52, 54, and 56 are exemplary, and that they may be rearranged between any of the inlet ports and outlet ports as desired to achieve a desired pump configuration. The direction of operation of any of the pump configurations is easily accomplished by reversing the orientation of the check valve(s) in their interconnecting passages and reversing the direction of rotation of the drive, as noted further above. Moreover, it is possible to join two or more cases together in tandem to increase the output of the pump assembly. A two-case pump configuration is indicated in FIG. 2 of the drawings, with the second case 12*a* being shown in broken lines in FIG. 2. The two cases 12 and 12*a* would include an intermediate plate 27 therebetween, the intermediate plate 27 having two mutually opposed elliptical guides (as shown on the second end plate 28 in FIG. 1) disposed upon its oppositely facing surfaces and a driveshaft passage disposed therethrough in the manner of the first end plate 26. It will be seen that any number of cases may be joined together in tandem, each adjacent pair of cases having an intermediate plate disposed therebetween. The various diaphragm actuators in such a multiple case pump may be rotationally staggered relative to one another to produce an even smoother output from the multiple chambers of such a pump.

It is to be understood that the present invention is not limited to the embodiments described above, but encompasses any and all embodiments within the scope of the following claims.

I claim:

1. A rotary diaphragm pump, comprising:

at least one case having a first end, a second end opposite the first end, and a plurality of chambers surrounding an elliptical cavity, wherein the plurality of chambers comprises four chambers and each of the chambers includes an inlet port and an outlet port;

a first end plate disposed upon the first end of the case;

a second end plate disposed upon the second end of the case;

an elliptical diaphragm frame disposed within the elliptical cavity of the case;

a flexible, resilient diaphragm having the form of a closed band, the diaphragm being disposed about the diaphragm frame, the diaphragm sealing each of the chambers from one another and from the elliptical cavity; and a rotary mechanism disposed within the elliptical cavity of the case, the mechanism selectively rotating within the case and periodically distending the diaphragm into each of the chambers of the case, thereby producing a pumping action.

2. The rotary diaphragm pump according to claim 1, wherein:

the diaphragm frame defines at least one elliptical track therein; and the rotary mechanism comprises an articulating pantograph having:

a generally rhomboid configuration;

a plurality of track wheels disposed upon the pantograph mechanism, the wheels traveling along the at least one elliptical track of the diaphragm frame; and a plurality of piston rollers disposed upon the pantograph mechanism, the rollers periodically distending the diaphragm into each of the chambers of the case, thereby producing the pumping action.

3. The rotary diaphragm pump according to claim 1, wherein the elliptical cavity has a center, a minor axis, and a periphery, the chambers having a periphery defined by the equation $R=\sqrt{L^2-r^2}$ where R is the radial distance from the center of the elliptical cavity to the periphery of the chambers, L is the fixed length hypotenuse of a right triangle having its right angle at the center of the elliptical cavity, and r is the length of the leg of the right triangle extending from the center of the elliptical cavity to a point along the periphery of the elliptical cavity.

4. The rotary diaphragm pump according to claim 1, further comprising:

an interconnecting passage extending between the inlet port of at least one of the chambers and the outlet port of another one of the chambers; and a one-way check valve disposed in the interconnecting passage.

5. The rotary diaphragm pump according to claim 1, further comprising an elliptical guide protruding inward from each said end plate.

6. The rotary diaphragm pump according to claim 1, wherein said at least one case comprises a plurality of cases joined to one another in tandem, the rotary diaphragm pump further comprising an intermediate end plate disposed between each of the cases.

7. A rotary diaphragm pump, comprising:

at least one case having a first end, a second end opposite the first end, and a plurality of chambers surrounding an elliptical cavity, each of the chambers having a fluid input port and a fluid output port;

a first end plate disposed upon the first end of the case;

a second end plate disposed upon the second end of the case;

an elliptical diaphragm frame disposed within the elliptical cavity of the case, the diaphragm frame defining at least one elliptical track;

a flexible, resilient diaphragm, the diaphragm being an endless loop disposed about the diaphragm frame, the diaphragm sealing each of the chambers from one another and from the elliptical cavity;

a diaphragm actuator having:

four elongate links;

four pivot pins connecting the ends of the four elongate links to form a four-bar linkage having a rhomboid configuration;

piston rollers rotatably mounted on two of the pivot pins diagonally opposite each other;

track wheels rotatably mounted on the other two diagonally opposite pivot pins; and a pair of elongate crank bars pivotally attached to one parallel pair of the links at a midpoint of the elongate links on opposite sides of the four bar linkage, the crank bars having a keyway defined at a midpoint of the elongate crank bars, the diaphragm actuator being disposed in the elliptical cavity with the track wheels rotating on the diaphragm frame track and the piston rollers being extendible through the diaphragm frame to bear against the diaphragm; and a keyed drive shaft inserted through the keyway in the crank bars;

wherein selective rotation of the keyed drive shaft causes the piston rollers to push the resilient diaphragm into diagonally opposite chambers in the case, followed by retraction of the piston rollers and diaphragm from the chambers to pump fluid through the input and output ports of the chambers.

8. The rotary diaphragm pump according to claim 7, wherein said at least one elliptical track comprises parallel first and second elliptical tracks defined by the diaphragm frame.

9. The rotary diaphragm pump according to claim 7, wherein the elliptical cavity has a center, a minor axis, and a periphery, the chambers having a periphery defined by the equation $R=\sqrt{L^2-r^2}$ where R is the radial distance from the center of the elliptical cavity to the periphery of the chambers, L is the fixed length hypotenuse of a right triangle having its right angle at the center of the elliptical cavity, and r is the length of the leg of the right triangle extending from the center of the elliptical cavity to a point along the periphery of the elliptical cavity.

10. The rotary diaphragm pump according to claim 7, wherein the plurality of chambers comprises four chambers.

11. The rotary diaphragm pump according to claim 10, further comprising:

an interconnecting passage extending between the inlet port of at least one of the chambers and the outlet port of another one of the chambers; and a one-way check valve disposed in the interconnecting passage.

12. The rotary diaphragm pump according to claim 7, further comprising an elliptical guide protruding inwardly from each end plate, the track wheels rolling between the elliptical guides and the tracks defined by the diaphragm frame.

13. The rotary diaphragm pump according to claim 7, wherein said at least one case comprises a plurality of cases joined to one another in tandem, the rotary diaphragm pump further comprising an intermediate end plate disposed between each of the cases.

14. A rotary diaphragm pump, comprising:

at least one case having a first end, a second end opposite the first end, and a plurality of chambers surrounding an elliptical cavity, the elliptical cavity having a center, a minor axis, and a periphery, the chambers having a periphery defined by the equation $R=\sqrt{L^2-r^2}$ where R is the radial distance from the center of the elliptical cavity to the periphery of the chambers, L is the fixed length hypotenuse of a right triangle having its right angle at the center of the elliptical cavity, and r is the length of the leg of the right triangle extending from the center of the elliptical cavity to a point along the periphery of the elliptical cavity;

a first end plate disposed upon the first end of the case;

a second end plate disposed upon the second end of the case;

an elliptical diaphragm frame disposed within the elliptical cavity of the case, the diaphragm frame defining at least one elliptical track;

a flexible, resilient diaphragm, the diaphragm being an endless loop disposed about the diaphragm frame, the diaphragm sealing each of the chambers from one another and from the elliptical cavity;

a diaphragm actuator having:

four elongate links;

four pivot pins connecting the ends of the four elongate links to form a four-bar linkage having a rhomboid configuration;

piston rollers rotatably mounted on two of the pivot pins diagonally opposite each other;

track wheels rotatably mounted on the other two diagonally opposite pivot pins; and a pair of elongate crank bars pivotally attached to one parallel pair of the links at a midpoint of the elongate links on opposite sides of the four bar linkage, the crank bars having a keyway defined at a midpoint of the elongate crank bars, the diaphragm actuator being disposed in the elliptical cavity with the track wheels rotating on the diaphragm frame track and the piston rollers being extendible through the diaphragm frame to bear against the diaphragm; and a keyed drive shaft inserted through the keyway in the crank bars;

wherein selective rotation of the keyed drive shaft causes the piston rollers to push the resilient diaphragm into diagonally opposite chambers in the case, followed by retraction of the piston rollers and diaphragm from the chambers to pump fluid through the input and output ports of the chambers.

15. The rotary diaphragm pump according to claim 14, wherein:

the plurality of chambers comprises four chambers; and each of the chambers includes an inlet port and an outlet port.

16. The rotary diaphragm pump according to claim 15, further comprising:

an interconnecting passage extending between the inlet port of at least one of the chambers and the outlet port of another one of the chambers; and a one-way check valve disposed in the interconnecting passage.

17. The rotary diaphragm pump according to claim 14, wherein said at least one case comprises a plurality of cases joined to one another in tandem, the rotary diaphragm pump further comprising an intermediate end plate disposed between each of the cases.

* * * * *